United States Patent [19]

Buchholz

[11] 4,134,202

[45] Jan. 16, 1979

[54] DRY SHAVER FOIL HEADS

[75] Inventor: Alexis E. Buchholz, Hauterive, Switzerland

[73] Assignee: The Gillette Company, Boston, Mass.

[21] Appl. No.: 848,348

[22] Filed: Nov. 3, 1977

[30] Foreign Application Priority Data

Nov. 4, 1976 [GB] United Kingdom ..... 45849/76

[51] Int. Cl.[2] ..... B26B 19/02

[52] U.S. Cl. ..... 30/43.92; 30/346.51

[58] Field of Search ..... 30/43.7, 43.8, 43.9, 30/43.91, 43.92, 346.51

[56] References Cited

U.S. PATENT DOCUMENTS

| | | | |
|---|---|---|---|
| 3,440,725 | 4/1969 | Messinger | 30/43.91 |
| 3,997,969 | 12/1976 | Czerner | 30/346.51 X |
| 4,009,518 | 3/1977 | Locke | 30/346.51 X |

FOREIGN PATENT DOCUMENTS

| | | | |
|---|---|---|---|
| 1025299 | 2/1958 | Fed. Rep. of Germany | 30/43.92 |
| 1177035 | 8/1964 | Fed. Rep. of Germany | 30/346.51 |
| 2159791 | 6/1973 | Fed. Rep. of Germany | 30/43.92 |
| 1456077 | 10/1966 | France | 30/43.92 |

*Primary Examiner*—Gary L. Smith

*Attorney, Agent, or Firm*—Richard A. Wise; Donald E. Mahoney

[57] ABSTRACT

A dry shaver foil head comprising a frame having arcuate support surfaces at opposite ends, and a part-cylindrical foil having opposite arcuate end portions respectively seated on said arcuate support surfaces. One longitudinal edge portion of the foil is attached to the frame by hooks, on the reinforced foil edge portion, hooked over a rigid rod also serving as the hinge pin which hinges the shaver head to a shaver body. The other longitudinal edge portion of the foil is attached to the frame by hooks, on the reinforced foil edge portion, hooked over a resilient rod at points spaced from points where the resilient rod is held by the frame. The resilient rod is thereby resiliently curved to maintain the foil in a state of significant tension to seat the foil on the frame in a substantially rigid part-cylindrical shape.

6 Claims, 4 Drawing Figures

Fig. 1
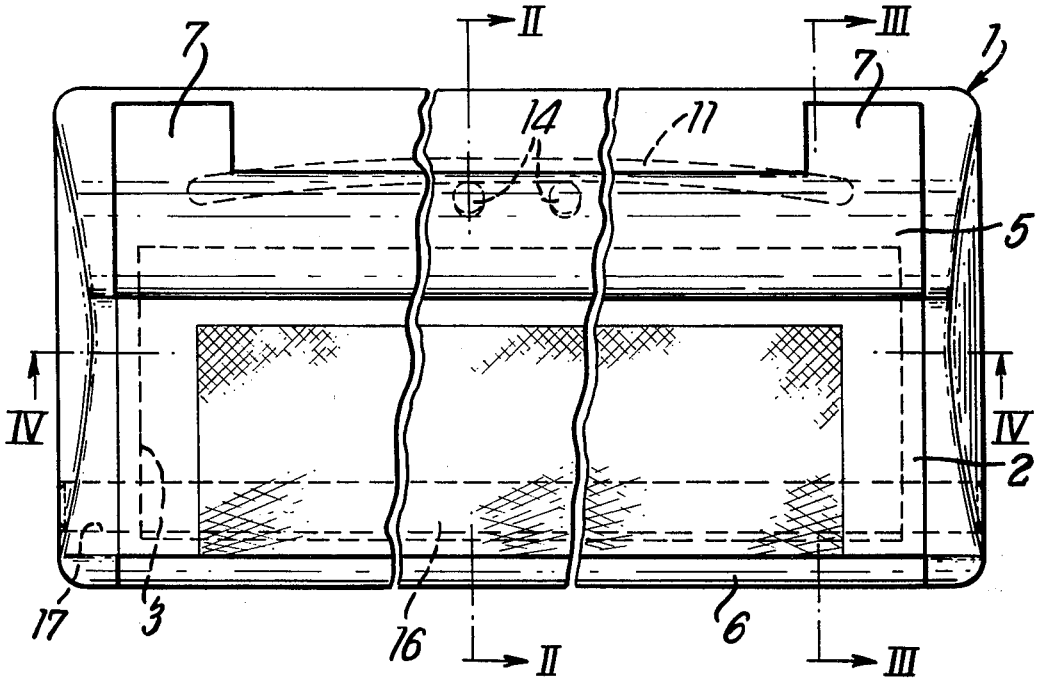
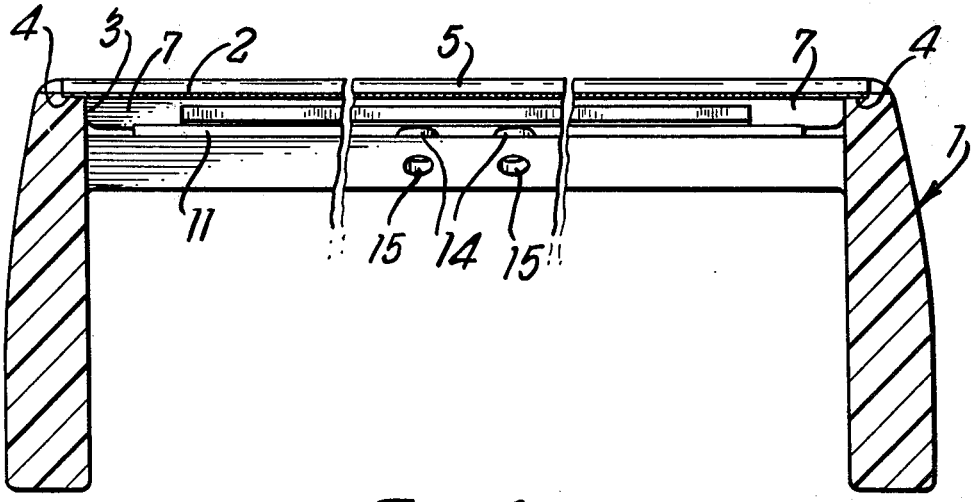
Fig. 4

DRY SHAVER FOIL HEADS

BACKGROUND OF THE INVENTION

This invention relates to dry shavers of the kind in which an oscillating cutter cooperates with a thin perforated shaving foil, and it is particularly concerned with shaver foil heads for use with an arcuately oscillating cutter.

A shaving foil has to fulfil two conflicting requirements. In order to provide a close shave it must be thin and hence essentially of a flexible and inherently non-rigid character. However, when mounted on the shaver, the foil must be held substantially rigidly in a part-cylindrical shape for continuous close contact with the cutting edges of the blades of the cutter. This applies particularly in shavers having a cutter which is oscillated arcuately about an axis coincident with the axis of the part-cylindrical foil. In a known arrangement substantial rigidity is achieved by means of small spaced arches which maintain the foil shape but this has the disadvantages that the effective cutting area of the foil is correspondingly reduced, its fabrication cost is high and its construction is bulky.

An object of the invention is to provide a dry shaver foil head in which the foil is held substantially rigidly in an improved manner.

SUMMARY OF THE INVENTION

According to the present invention there is provided a dry shaver foil head comprising a frame providing first and second arcuate support surfaces at opposite ends thereof, a part-cylindrical shaving foil having opposite arcuate end portions respectively seated on said arcuate support surfaces, first and second attachment means respectively attaching opposite longitudinal edge portions of said foil to said frame, at least one of said attachment means including resilient means applying tension to the foil between said first and second attachment means whereby to hold said foil substantially rigidly in position.

Preferably, the or each said resilient means comprises a resilient rod extending generally parallel to a said longitudinal edge portion of said foil, said rod being acted upon at spaced points along its length by said foil and by said frame resiliently to curve said rod to apply said tension to said foil.

BRIEF DESCRIPTION OF THE DRAWINGS

An embodiment of the invention will now be described, by way of example, with reference to the accompanying drawings, in which:

FIG. 1 is a top view of a dry shaver foil head according to the invention, i.e. looking down on the foil;

FIG. 4 is a sectional view on the line IV—IV in FIG. 1.

DESCRIPTION OF PREFERRED EMBODIMENT

Figure 2:
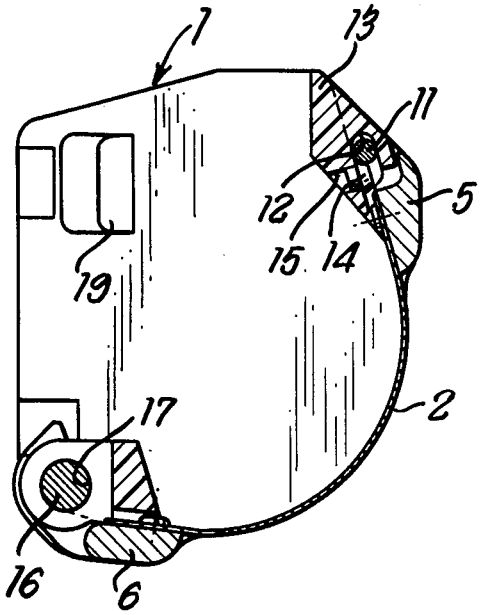
FIG. 2 is a sectional view on the line II—II in FIG. 1.

Referring to the drawings there is shown a dry shaver foil head comprising a moulded head frame 1 and a thin perforated shaving foil 2 attached thereto. The frame 1 defines a rectangular opening 3 within which, when the head is fitted to a shaver body, there is received an arcuately reciprocable cutter head comprising cutter blades having edges in continuous close contact with the foil. The shaver body and cutter head are conventional and well known to those skilled in the art so will not be further described or illustrated. The frame 1 provides first and second arcuate support surfaces 4 (FIG. 4) at the opposite ends thereof. The foil 2 is part-cylindrical in shape when in position and has opposite arcuate end portions respectively seated on the arcuate support surfaces 4, to define the part-cylindrical shape of the foil.

The foil 2 is provided along each longitudinal edge portion with respective reinforcing members 5 and 6. The members 5 and 6 seat against the frame 1 and locate within the opposite end walls of the frame 1 as seen in FIGS. 1 and 4 to provide longitudinal location for the foil 2 with respect to the frame 1. Opposite longitudinal edge portions of the foil are removably attached to the frame by respective first and second attachment means. The attachment means may be the same or different from one another, but at least one of the attachment means includes resilient means applying tension to the foil between the respective attachment means whereby to hold the foil substantially rigidly in position in its part-cylindrical shape.

Figure 3:
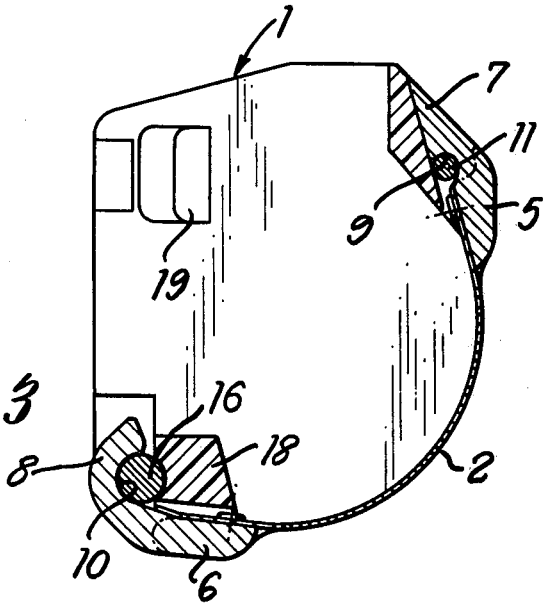
FIG. 3 is a sectional view on the line III—III in FIG. 1.

One attachment means comprises two spaced apart hook members 7 formed integrally with the reinforcing member 5 at opposite end portions thereof as shown in FIGS. 1, 3 and 4, the hook members 7 each having an internal recess 9. The other attachment means comprises two spaced apart hook members 8 formed integrally with the reinforcing member 6 at opposite end portions thereof as shown in FIGS. 2 and 3, the hook members 8 each having an internal recess 10.

The hook members 7 of the first attachment means hook over a resilient rod 11 which extends generally parallel to the adjacent longitudinal edge portions of the foil. The rod is acted upon at opposite end portions thereof by hook members 7 as shown in FIGS. 1 and 3, and is acted upon substantially centrally by the frame so as resiliently to curve the rod concavely towards the foil as shown in FIG. 1. Tension is thereby applied to said foil between the attachment means whereby to maintain the foil substantially rigidly in its part-cylindrical shape with the opposite arcuate end portions of the foil seated on the arcuate frame surfaces 4.

The central portion of the resilient rod 11 extends through a slot 12 formed in a second portion 13 of the frame moulding 1 as shown in FIG. 2. The rod 11 is laterally confined within the slot 12 by two spaced studs 14 received in bores 15 formed in the frame 1 adjacent the second portion 13. One stud 14 would suffice but two are preferred. The resilient rod 11 is acted upon by the frame by bearing against the heads of the studs 14 whereby resiliently to curve the rod as seen in FIGS. 1 and 2. The studs 14 have part-conical heads so that the force exerted between the resiliently curved rod 11 and the studs 14 serves to retain the studs in the bores 15 by cam action against their heads.

In the other attachment means, the hook members 8 hook over a substantially rigid rod 16 which extends parallel to the adjacent longitudinal edge portions of the foil. The end portions of the rod 16 are received in bores 17 (FIGS. 1 and 2) in the end walls of the frame 1. As described above, the hook members 8 are provided at opposite end portions of the reinforcing member 6 and lie adjacent the end walls of the frame 1. The frame moulding includes integrally moulded abutments 18 (FIG. 3) extending inwardly from each end wall thereof opposite the hook members 8 to provide equal and opposite reaction to the lateral force exerted on the end portions of rod 16 by the tension in the foil.

The rod 16 also serves as a hinge pin by which the complete illustrated head is hinged to the body of a dry shaver in conventional manner well known to those skilled in the art, to permit the head to be opened to allow access for cleaning the cutter head. The frame moulding 1 also includes internal projections 19 to provide snap-action closure of the head as it is hinged closed against the shaver body, again as conventional in this art.

The foil 2 is fitted or replaced on the head frame as follows. The hook members 7 are first hooked over the ends of the spring rod 11 which has been previously located in its slot 12 by studs 14. The foil is then wrapped over the arcuate support surfaces 4 under hand tension and the other hook members 8 hooked over the rigid rod 16. The foil is thereby held in the required part-cylindrical shape and the lateral tension therein serves to provide the required substantial rigidity of the foil. The foil is readily detachable if required. The magnitude of the tension in the foil is chosen to suit a particular shaver head, but in one embodiment a tension of substantially 1 kilogram was found suitable and advantageous according to this invention.

I claim:

1. A dry shaver foil head comprising:

a frame having first and second opposite end walls and first and second opposite side walls, said first and second opposite end walls provided with respective first and second arcuate support surfaces;

a part-cylindrical shaving foil having first and second opposite arcuate end portions and first and second opposite longitudinal edge portions, said foil arcuate end portions respectively seated on said frame arcuate support surfaces;

first and second attachment means, said attachment means respectively attaching said opposite longitudinal edge portions of said foil to said frame;

at least one of said attachment means including a resilient rod, said resilient rod applying tension to said foil between said first and second attachment means to hold said foil substantially rigidly in position, said rod extending generally parallel to a said longitudinal edge portion of said foil, and said rod being acted upon at spaced points along its length by said foil and by said frame resiliently to curve said rod to apply said tension to said foil; and said frame having a bore and a stud received in said bore, said stud having a part-conical head, and said frame acting on said resilient rod by way of said resilient rod bearing against said part-conical head, whereby said bearing action serves to retain said stud in said bore.

2. A dry shaver foil head according to claim 1 wherein said foil acts on opposite end portions of said rod, and said frame acts on a central portion of said rod to curve said rod concavely towards said foil.

3. A dry shaver foil head according to claim 1 wherein said foil is provided along each said longitudinal edge portion with a reinforcing member, and wherein said at least one attachment means comprises hook means, said hook means associated with a said reinforcing member and adapted to hook over said resilient rod.

4. A dry shaver foil head according to claim 3 wherein said hook means comprises first and second longitudinally spaced hooks, said hooks formed integrally with said reinforcing member at opposite end portions thereof.

5. A dry shaver foil head according to claim 1 wherein one of said attachment means comprises said resilient means and the other said attachment means comprises hook means, said hook means associated with said foil, a substantially rigid rod extending parallel to a said longitudinal edge portion of said foil, and means mounting said rigid rod in said frame, said hook means hooked over said rigid rod.

6. A dry shaver foil head according to claim 5 wherein said substantially rigid rod serves also as a hinge pin, said hinge pin adapted to hinge said shaver foil head to the body of a dry shaver.

* * * * *